United States Patent [19]

Fischer et al.

[11] 4,348,581

[45] Sep. 7, 1982

[54] ELECTRIC HOTPLATE

[75] Inventors: Karl Fischer, Am Gänsberg 23, D-7519 Oberderdingen; Felix Schreder, Oberderdingen, both of Fed. Rep. of Germany

[73] Assignee: Karl Fischer, Fed. Rep. of Germany

[21] Appl. No.: 177,873

[22] Filed: Aug. 14, 1980

[30] Foreign Application Priority Data

Aug. 17, 1979 [DE] Fed. Rep. of Germany ..... 2933296

[51] Int. Cl.[3] ..... H05B 3/68

[52] U.S. Cl. ..... 219/460; 219/458; 219/461

[58] Field of Search ..... 219/443, 451, 455–467

[56] References Cited

U.S. PATENT DOCUMENTS

| | | | |
|---|---|---|---|
| 1,093,754 | 4/1914 | Ball | 219/458 |
| 1,174,030 | 2/1916 | Hadaway, Jr. | 219/455 |
| 1,639,382 | 8/1927 | Moffat | 219/467 |
| 1,644,255 | 10/1927 | Kercher et al. | 219/465 |
| 1,660,556 | 2/1928 | Gunn | 219/458 |
| 2,260,165 | 10/1941 | Calhoun | 219/461 |
| 2,666,979 | 1/1954 | Dusen | 219/433 |
| 3,348,025 | 10/1967 | Basset, Jr. et al. | 219/464 |
| 3,593,653 | 7/1971 | Buerki | 219/461 |

FOREIGN PATENT DOCUMENTS

| | | | |
|---|---|---|---|
| 2313347 | 4/1973 | Fed. Rep. of Germany | 219/455 |
| 432000 | 12/1911 | France | 219/459 |
| 844739 | 7/1939 | France | 219/465 |
| 44126 | 3/1926 | Norway | 219/459 |

*Primary Examiner*—Bernard Roskoski

*Attorney, Agent, or Firm*—Steele, Gould & Fried

[57] ABSTRACT

An electric hot plate with a cast member has a downwardly-directed border on its outer periphery. The edge of a covering sheet centrally fixed to the hot plate by a hollow screw rests on the lower edge of the border. A covering sheet step is centered within the border. A moisture-proof closure is obtained through an interposed seal and insulation is provided by a crinkled aluminum foil. The hot plate connecting leads are passed via an insulating member through the covering sheet which, peripherally displaced by 180°, faces a depression in the covering sheet so that hot plates according to the invention can be stacked in a space-saving manner. The connecting leads are flexible and their ends are brought together in a common connecting member.

17 Claims, 15 Drawing Figures

ELECTRIC HOTPLATE

The invention relates to an electric hotplate with a hotplate member which has a downwardly directed annular border on its outer periphery on which a covering sheet rests. An electric hotplate of this kind with a central sensor is known. The covering sheet is placed flat on the border and is secured thereto with two threaded bolts. The covering sheet does not fit very tightly and is difficult to center. If, under extreme conditions, e.g. when the hotplate is transported by sea, moisture penetrates into the space covered by the covering sheet, this moisture may increase the leakage currents.

The aim of the invention is to provide an electric hotplate wherein the covering sheet is satisfactory centered and is mounted in a more satisfactorily sealed manner.

According to the invention, the covering plate has a step directed towards the inside of the hotplate and adjoining the border zone resting on the free lower edge of the border, which step cooperates with the inner periphery of the border for the centering of the covering sheet.

No more open gaps are formed and a particular advantage is that a seal can readily be interposed. Because of the relatively large spacing of the abutment surface from the heating means, the seal is not exposed to particularly high temperatures. Advantageously, the covering sheet is applied very uniformly from the central zone outwards.

BACKGROUND OF THE INVENTION

This form of covering sheet also makes it possible to provide an insulation which may advantageously consist of a metal foil insert. Either in conjunction with this metal foil or separately, a drying agent may also be provided, which is automatically regenerated by the high temperature prevailing when the hotplate is in use.

In known hotplates (DE-OS No. 26 51 848), the electrical connection for the hotplate is provided by means of a ceramics connecting piece which is located at one end of a carrier sheet secured to the covering sheet. An insulating member projects through the covering sheet and carrier sheet. Connecting leads in the form of solid bars or wires run through this insulating member and parallel to the carrier sheet and into the connecting member. Although the fixed arrangement of the connecting member has proved very satisfactory, it would nevertheless be desirable to improve installation, particularly in a hotplate of extremely flat construction, and to improve the storage and transport capabilities for hotplates of this kind.

SUMMARY OF THE INVENTION

It is therefore proposed that the connecting leads with heat-resistant insulation coming out of the electric hotplate be made flexible and lead to a common connecting member, mounted in freely movable manner, with connecting clips, the connecting leads being long enough to enable the connecting member to be mounted outside the region of the electric hotplate.

Although it is known to provide insulated flexible connecting leads for electric hotplates, these leads have usually been very long and had free ends. They were therefore awkward to handle, had to be shortened for fitting or else resulted in unnecessarily long leads which caused waste, made the installation complicated and gave rise to risks of short circuits, and also added to the variety of types on the market, produced with different lengths of lead. The proposed connecting member is certainly flexible in movement and meets all the installation requirements but is located outside the heated area of the hotplate and yet does not get in the way when installed. For transporting and storage, the connecting member can be bent so that it takes up no more vertical space than the electric hotplate itself. It can either be folded outwards in the spaces formed between the round hotplates or can be folded inwards to rest in a recess in the covering sheet of the hotplate.

In known electric hotplates (DE-PS No. 26 20 004), a central bolt which serves to secure the lower covering sheet and to fix the hotplate to a fixing bracket on the cooker projects far beyond the underside and anti-rotation pins project beyond the underside. The insulating member located above also increases the height of the construction. For storage and transport, the hotplates have to be stacked by means of small pieces of wood placed on their outer edges, and this has to be done manually. For safe transporting, in a particularly space-saving arrangement, the hotplate can be further improved so that the hotplates are placed on top of each other with the cooking surfaces and undersides facing one another, but arranged in a position which is offset by 180° in the circumferential direction, with an insulating member engaging in the recess in the covering sheet. Moreover, since there are preferably no securing bolts or anti-rotation bolts, the hotplate when stacked may even take up less vertical space than its own overall height.

It is also possible to stack the hotplates so that they are precisely aligned in the axial direction, so that the outer edges of the hotplate members rest flush on one another with centering packing plates located therebetween. Thus, a safe, solid stack is formed which reduces the transporting and storage costs and decreases the risk of damage.

In this way, it is also possible to support the covering sheet on the free lower edge of the continuous border of the hotplate; previously, this was only possible at the risk of certain disadvantages, owing to the stacking capabilities. The recess provided at this border and the corresponding embossed portion in the covering sheet provide an automatic abutment for packing in the position which is offset by 180° in the circumferential direction.

From DE-PS No. 26 20 004, it is known to screw the threaded bolt into the central pin of the hotplate member and to fix the covering sheet in position by means of a nut screwed thereon. Therefore, two threading operations are required. Moreover, the threaded bolt protrudes some way out of the hotplate, with the result that the packed dimensions are twice as large as the entire height of the hotplate and, furthermore, for transporting, adjacent hotplates have to be axially offset so as not to increase the packing dimensions still further. The protruding part of the threaded bolt is intended to attach the hotplate to a bracket by means of another nut screwed on, by which the hotplate is clamped downwardly.

If, on the other hand, the screw is advantageously a hollow cap screw with an external and internal thread, the cap of which secures the covering sheet, and into which it is possible to screw a fixing screw for the electric hotplate, it is only necessary to screw in the hollow screw to secure the covering sheet when assembling the hotplate. Later, when the hotplate is fitted, a conventional cap screw is used to secure the hotplate. The hollow screw can be secured more satisfactorily and the packing and transporting work is reduced. In addition, there is greater adaptability to different heights of installation, as it is merely necessary to use different cap screws.

BRIEF DESCRIPTION OF THE DRAWINGS

Further advantages and features of the invention are given in the subclaims and described in the specification in conjunction with the drawings. Some exemplary embodiments of the invention are illustrated in the drawings and described more fully hereinafter. In the drawings:

DETAILED DESCRIPTION OF THE PREFERRED EMBODIMENTS

Figure 1:
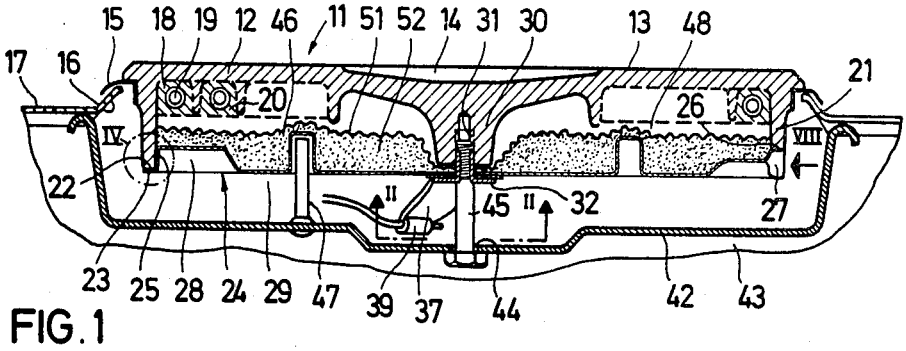
FIG. 1 is a cross section through an electric hotplate installed in an electric cooker, hob or the like, FIG. 2 is a detailed view, in section on the line II—II in FIG. 1.

FIG. 1 shows an electric hotplate 11 comprising a hotplate member 12 consisting of cast iron with a flat, sealed, upper cooking surface 13. The unheated central zone 14 is recessed so as to form an annular cooking surface. At its outer periphery, the hotplate member engages over an overflow rim 15 consisting of sheet material of substantially U-shaped cross section, which rests on the raised rim 16 of the opening in the work plate 17 of an electric cooker or hob.

In the heated annular zone, the hotplate is provided with ribs extending in a spiral configuration which form between them spiral grooves 18 in which there are provided heating coils 19 embedded in a ceramics mass 20.

A downwardly directed, substantially cylindrical border 21 projects in the circumferential region of the hotplate member, while a flange-like border region of a cylindrical covering sheet 24 which is deformed and reinforced by embossed portions rests on the lower edge 22 of said border 21. The covering sheet 24 has a border region 23 adjoined by a step 25 which is directed upwardly, i.e. towards the cooking surface, and which abuts on the inside of the border 21 and thus centers the covering sheet or cover.

Figure 8:
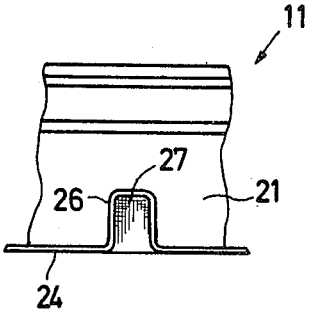
FIG. 8 shows a detail, viewed in the direction of the arrow VIII in FIG. 1.

At one point on its circumference, the border 21 has a recess 26 in the form of a rectangular cutout (FIG. 8) into which a corresponding embossed portion 27 of the covering sheet fits and thus prevents rotation of the covering sheet 24 on the hotplate member in spite of the relatively tight seal provided. For its part, the embossed portion 27 of the covering sheet ensures that the finished hotplate can be aligned in the circumferential direction when being handled during production. As a result, no inner projection on the border 21 is required.

Adjoining the step 25 is a region 28 of the covering sheet which is recessed relative to the border region 23 and adjoining said region 28 is a central region 29 which projects to some extent relative to the border region 23.

Figure 2:
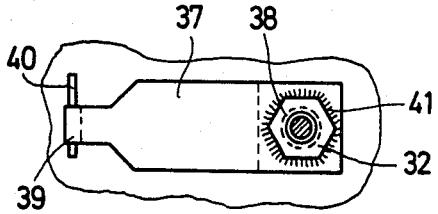
Figure 9:
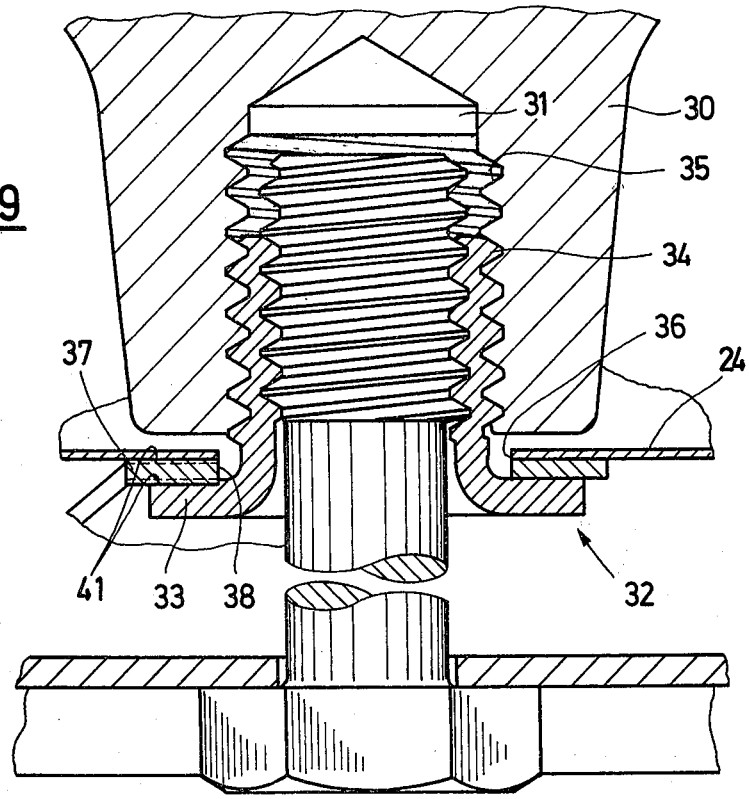
FIG. 9 shows an enlarged view of the detail showing the central fixing of the hotplate according to FIG. 1.

In the center of the unheated central zone 14, the hotplate member has a downwardly projecting pin 30 into which a threaded blind bore 31 projects from below. A hollow cap screw 32, shown in detail in FIG. 9, is screwed into this threaded bore. This screw 32 consists of a stamped or deep-drawn sheet metal part with a flange-like cap region 33 with a hexagonal spanner surface and a sleeve-shaped threaded portion 34 adjoining the latter, into which an internal and external thread is pressed or forced. The screw 32 projects through a central hole 36 in the covering sheet 24 and is screwed into the thread 35 of the bore 31 so that the covering sheet 24 is pressed with its border region 23 against the lower edge 22 of the border 21 of the hotplate member 12. Interposed between the head 32 and the covering sheet there is a sheet metal part 37 (FIG. 2) in the form of a sheet metal strip having, on one side, a hole 38 through which the screw 32 passes, while the other end tapers somewhat and a bent end 39 (FIGS. 1 and 2) surrounds an earth lead 40. The earth lead may be pressed or welded on to the sheet metal part 37. Thus, this sheet metal part is simply placed under the screw head 33 like a washer and provides a safe earth connection. It is particularly advantageous if the sheet metal part lies flat against the underside of the covering sheet 24 during production and shipping and is not bent away from the covering sheet until required. As a result, the earth connection does not substantially increase the height of the hotplate.

The left-hand side of FIG. 9 shows that the abutment surface of the head 33 can be provided with a preferably star-shaped groove 41. The sheet metal part 37 is correspondingly structured on its top and bottom, and so is the covering sheet 24 (cf. FIGS. 2 and 15), thus preventing the screw 32 from accidentally working loose. However, other securing methods may also be used.

The hotplate is held in the opening in the work plate which receives it by means of a bracket 42 which rests on the underside of the work plate 17 and has a flat U-shape. Its long back is reinforced by means of lateral bends 43. A cap screw 45 which is screwed into the internal thread in the hollow screw 32 projects through a hole 44 in the centre of the bracket. In this way, the hotplate is clamped down by the screw and bracket and is securely fixed in position. This method of attachment uses only cap screws, which can easily be tightened using automatic screw drivers. The screw 32 is a simple stamped sheet metal part and the screw 45 is a simple machine screw. Until now, hot plates have been fitted with screw bolts which were screwed into the pins 30 and projected far beyond the underside of the hotplate.

Two or more nuts screwed on to these bolts secured the covering sheet and hotplate to the bracket. Consequently, there was no possibility of a space-saving method of packing. Now, however, the hotplate when packed takes up only the room which its requires for itself and there is the additional advantage that the length of the screw 45 can be selected according to the height of the bracket. This is particularly important if the hotplate is to be fixed in very flat built-in hobs. Thus, one type of hotplate can be used for brackets of all heights. Previously, the various types of hotplates had to be fitted with screw bolts of different lengths for this purpose.

Riveted to the bracket 42 is an upwardly projecting rod 47 which engages in a sleeve-like recess 46 formed inwardly in one piece with the covering sheet, and thus prevents the hotplate from rotating relative to the bracket. In order to provide a number of possible methods of installation for the hotplate, which is particularly important because of the position of the connecting leads, a plurality of recesses 46 may be provided on the circumference, optionally also offset by 90° relative to one another. The fact that the anti-rotation rod 45 is mounted on the bracket instead of on the hotplate as before means that the overall dimensions of depth of the hotplate are kept small. The recess 46 is closed off so that the hot inner space 48 of the hotplate formed between the covering sheet 24 and the hotplate member 12 is sealed off.

Figure 3:
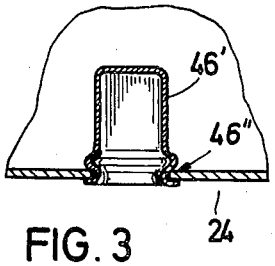
FIG. 3 is a section through an alternative embodiment of a detail from FIG. 1.

FIG. 3 shows an alternative embodiment for the recess 46 which may be used if the sheet metal from which the covering plate 24 is made should not be subjected to any great deformation. A separately produced sleeve 46' is tightly secured in an opening in the covering sheet 24 by means of a two-sided flange 46''. It is also possible to provide the sleeve, in the region of the flange 46'', for example, with a pressed-in thread for the subsequent screwing-in of a rod.

Figure 4:
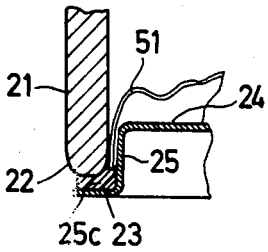
FIG. 4 shows the detail indicated by the dash-dot circle IV in FIG. 1, on a larger scale.
Figure 5:
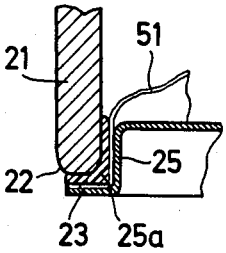
FIGS. 5 to 7 show alternative embodiments of the detail shown in FIG. 4.
Figure 6:
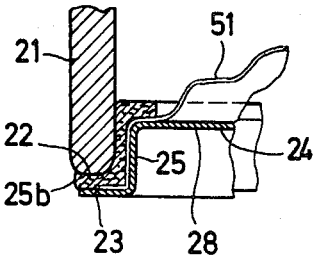

FIG. 4 shows a detailed view wherein a sealing ring **25*c*, which may be flat or circular in cross section and which is made of a heat-resistant sealing material, is inserted between the border region 23 of the covering sheet 24 and the lower edge 22 of the hotplate border 21. Suitable materials for the sealing ring 25*c* include silicon rubber, asbestos-containing sealing materials, etc. Other embodiments of seals are shown in FIGS. 5 and 6, the seal 25*a* in FIG. 5 consisting of a paste which is introduced into the angle between the border region 23 and the step 25 and spreads over the lower edge 22 and the inside of the border 21 when pressure is applied. This embodiment provides a particularly advantageous method of sealing in the region of the recess 26**.

FIG. 6 shows, at the corresponding point, a prefabricated sealing ring **25*b* of Z-shaped cross section which covers the lower edge 22, the inside of the border 21 and part of the inner surface of the recessed portion 28 of the covering sheet 24**. This sealing ring may consist of a moulding compound produced from an alumina-silicate fibre and impregnated with a lacquer based on silicon resin.

When a seal is used on the outer periphery it is also advisable to provide a seal in the region of the screw 32.

The seal is intended to prevent moisture from penetrating into the inner space 48 of the hotplate and thus possibly into the embedding mass 20 if the hotplate is exposed to extreme conditions, such as being transported by sea. Certainly, the hotplate will immediately repel any moisture which gets in, without producing any inadmissible leakage currents, but the seal provides an additional protection. The seal is established particularly by the abutment of the covering sheet on the lower flange, since this means that the seal is provided in a region of lower temperature and can be arranged better. Earlier covering sheets were placed on the underside of the embedding compound 20. The step 25 provides an additional seal and perfect centering.

Figure 7:
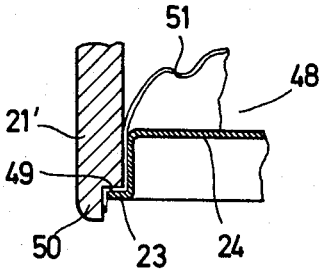

FIG. 7 shows an embodiment wherein the border 21' of the hotplate member comprises a step-shaped recess 49 on its inner underside so as to form an external continuous border portion 50 of the border 21' which extends somewhat further downwards than the abutment surface for the border region 23 of the covering sheet 24. This means that, if there is a risk of water running down under the hotplate, which can only happen in exceptional circumstances, the water will drip away without being sucked into the inner space 48 by capillary action.

FIG. 1 shows that a metal foil 51, more particularly a piece of bright crinkled aluminium foil, is located in the inner space parallel to the covering sheet. It is clamped between the border 21 and the covering sheet 24 or the seals provided (see FIGS. 4 to 7) and encloses, between itself and the covering sheet 24, a coating 52 which preferably consists of silica gel or kieselguhr or contains the latter. This material not only provides good insulation but also ensures that any moisture which has get in, e.g. as moisture from the air, is absorbed in the silica gel which acts as a drying agent. As a result of the automatic heating during operation of the hotplate, the drying agent is constantly regenerated automatically as the water is expelled and thus remains permanently effective. If a drying agent is used, it may be a good idea to perforate the metal foil or to place the drying agent in other containers in the inner space 48 to ensure that it is effective.

If there is no danger of any extreme conditions occurring as regards moisture levels, the coating 52 may be made from highly heat-resistant insulating materials such as inorganic fibres like asbestos or other known insulating materials. In conjunction with the metal foil located above, very effective insulation is obtained which further reduces any downward heat losses caused by radiation and convection, which are in any case very slight in contact-type hotplates. However, in particular this ensures that the temperature of the covering sheet 24 is kept low, so that the hotplate can be installed even in the flattest hobs near wooden parts of kitchen furniture.

Figure 10:
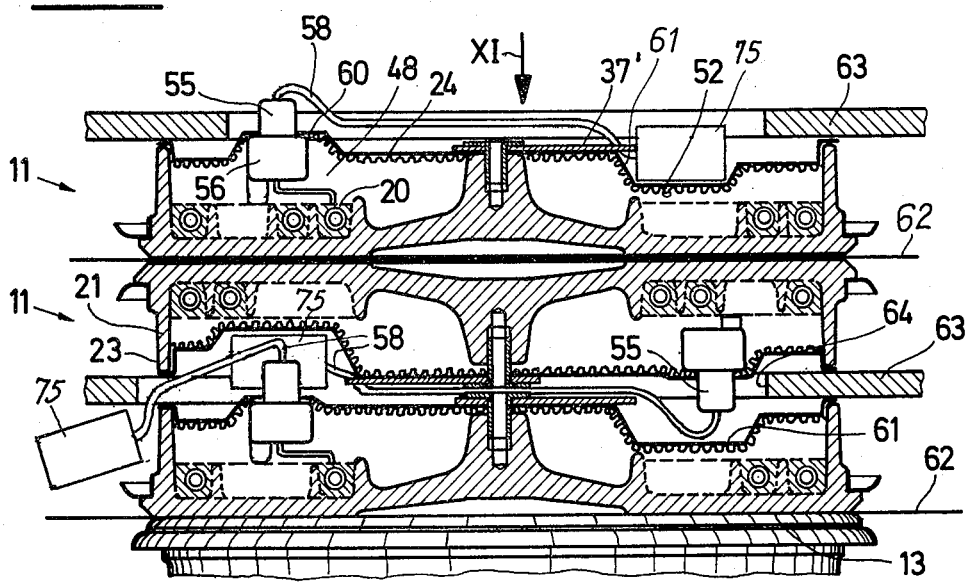
FIG. 10 shows three hotplates stacked one above the other, corresponding to the hotplate shown in FIG. 1, apart from the earth connection, and the associated packing means.
Figure 11:
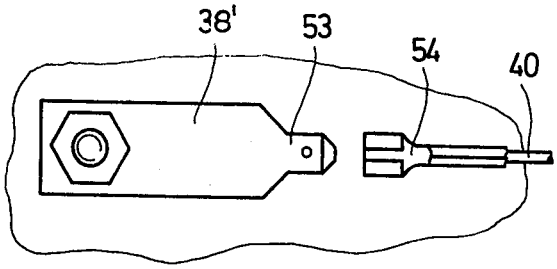
FIG. 11 shows a detailed plan view in the direction of the arrow XI in FIG. 10.

FIG. 10 shows three hotplates stacked one above the other; apart from the fact that the sheet metal part 38' (cf. FIG. 11) is provided with a flat insertion tongue 53 for the connection of a corresponding flat plug 54 for the earth lead 40, these hotplates are identical to the one shown in FIG. 1. Throughout the description, the same reference numerals have been used to denote identical parts. The direction of the section in FIG. 10 is offset by 45° relative to FIG. 1 so as to show that, projecting through the covering sheet 24, there is an insulating member 55 which rests inside the latter and contains a temperature limiting means in its portion located in the inner space 48 and comprises continuous openings 57 (FIG. 15) through which connecting leads 58 having a highly heat-resistant insulation project out of the inner space 48 where they are welded to connecting pins projecting out of the embedding mass 20. The basic form of the insulating member is elongated in the circumferential direction and it projects through the covering sheet in the region of a bulge 60.

The connecting leads 58 are connected to a common connecting member 75 of ceramics insulating material (FIGS. 10 and 15) which contains plug-in or screw connection clips 76 for the connection of current feed lines 78. Owing to the arrangement of the insulating member in the radial direction substantially in the center of the annular heated zone and the dimensions of the connecting leads, the outer edge 77 of the connecting member 75 is preferably at most at a spacing from the outer edge thereof which is less than a radius of the hotplate and can flexibly be adapted to the particular conditions of installation, the connecting leads acting as a flexible strip which permits slight pivoting and greater mobility of the connecting member in the vertical direction but more strongly restricts rotation and lateral movement.

Diametrically opposite the insulating member 55 and at a corresponding radial distance from the centre of the hotplate there is provided, in the covering sheet 24, a depression 61 the dimensions of which are such that it can safely receive the projecting portion of the insulating member in the mutual arrangement of the hotplate shown in FIG. 10, without the connecting leads 58 having to be bent too sharply. The width of the depression is substantially greater than that of the insulating member so that, as can be seen in FIG. 10 in the top two hotplates, the connecting leads 58 can be folded inwards and the connecting member 77 together with the insulating member can be placed in the depression 61. It is also possible to fold the connecting member 77 (bottom of FIG. 10) outwards and place it substantially in a plane with the hotplate, while the connecting leads 58 pass through a corresponding cutout in the packing plate 63.

Thanks to the depression in the covering sheet, it is possible to pack the hotplates in a particularly safe and space-saving manner for storage and dispatch. For this purpose, the hotplates are stacked one above the other with their central axes in alignment and with their flat cooking surfaces 13 and their undersides covered by the covering sheets 24 directed towards each other, while, between the cooking surface 13, only a sheet or film 62 is inserted, to prevent scratches, and between the undersides of the hotplates a packing plate 63 is placed, which may consist of plywood or pressboard and which has recesses designed so that the hotplate is centered when it is placed thereon. Parts of the hotplate projecting downwards relative to the outer edge 23 of the covering plate project into the recess 64 in the packing plate 63.

The hotplates 11 are offset by 180° relative to one another in the circumferential direction, so that the insulating member 55 with the connecting leads projects into the depression 61 and the hotplate even takes up less packing space than its own overall height. The borders 21 rest on one another, via the interposed packing plate 63, to form a firm stack with no tendency to tilt over. The aligned arrangement of the hotplates one above the other also particularly contributes to this. Depending on the desired packaging or pallet size, the packing plates 63 have a plurality of recesses 64 arranged side by side and behind one another so that a large number of hotplates can be stored and transported in a solid block; this not only saves storage and transporting costs but also gives greater protection against damage. Packing can also be carried out fully automatically by means of gripping devices.

The hotplates according to FIG. 10 do not have the silica gel filling. For insulation purposes only, crinkled aluminium foil 51 is placed parallel to the covering sheet 24.

Figure 14:
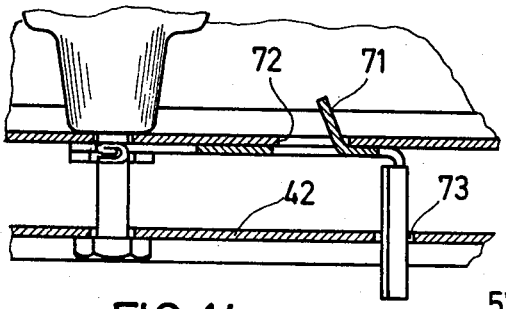
FIG. 14 shows a detailed section through the lower central region of a hotplate in the installed state.

FIGS. 12 to 15 show another apparatus for preventing the hotplate from rotating relative to the securing means, e.g. the bracket 42. For this purpose, a sheet metal part 65 is used in the form of a flat right-angled strip which extends through in the region of the bend 66. Lateral indentations 67 form separate border areas at the ends of the portions 68, which are bent over or rolled round at the ends (cf. FIG. 13 in particular), so that the ends are in the form of pins. U-shaped cutouts 70 are provided in the portions 68 so as to form sheet metal tabs which are bent out from the plane of the portions 68. FIG. 14 shows this sheet metal part 65 in the installed position. Like the sheet metal part 37 in FIG. 1 it is secured to the hotplate by the screw 32 and is prevented from rotating thereon by the tab 71 which projects through an opening 72 in the hotplate. Instead of the opening 72 a corresponding embossed portion could also be provided so as not to perforate the covering sheet. Preferably, the ends 69 are not bent out through about 90° until the hotplate is installed in a cooker or the like; this bending is easily effected thanks to the indentations 67. Only the end 69 which is to be inserted in a hole 73 in the fixing bracket 42' has to be bent out. This, too, provides a protection against rotation without increasing the transporting space.

Figure 12:
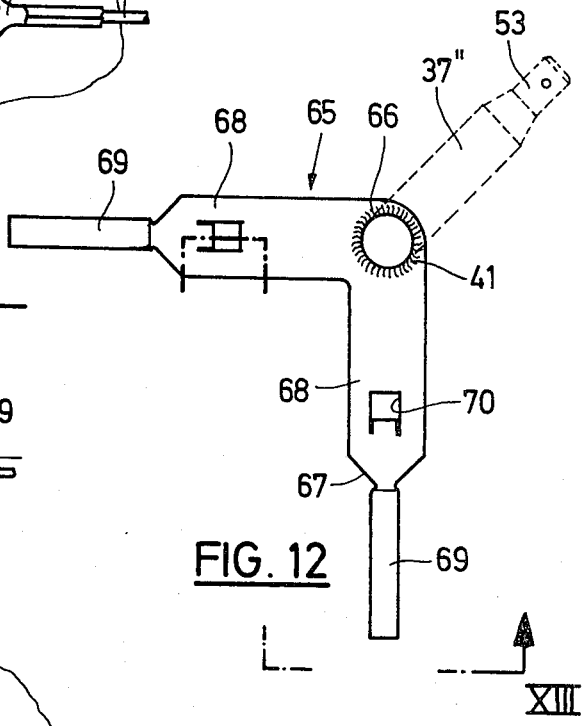
FIG. 12 shows a plan view of a sheet metal part used to prevent rotation and possibly act as an earth connection.
Figure 13:
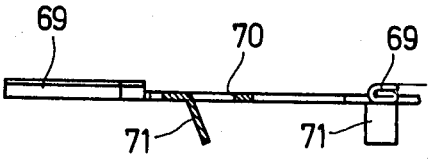
FIG. 13 shows a partially cut-away view on the line XIII—XIII in FIG. 12.
Figure 15:
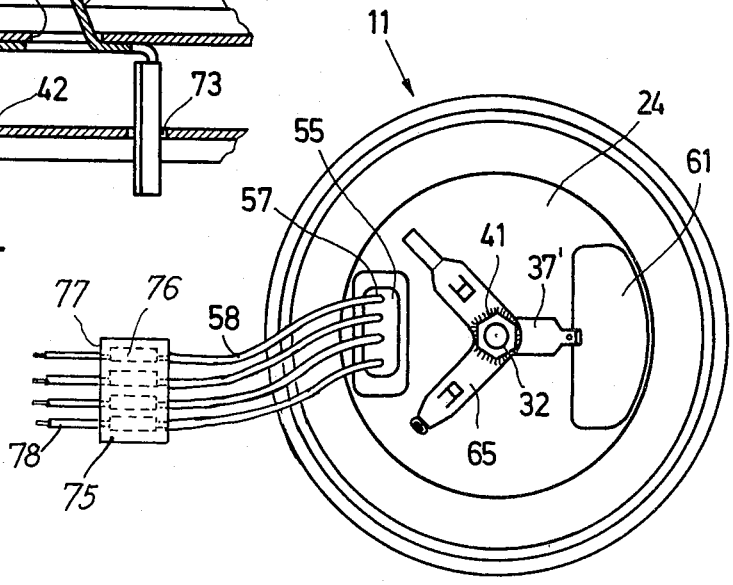
FIG. 15 shows a rear view of this hotplate.

FIG. 12 shows, by means of dash-dot lines, that the anti-rotation sheet metal part 65 may be provided with a third portion 37'' on whose end there is provided a flat insertion tongue 53 for the connection of an earth lead. In this way, one component can be used for a double function, namely preventing rotation and providing the earth connection. However, as shown in FIG. 15, it is also possible for the sheet metal part 37' in addition to the anti-rotation part 65 to be screwed on by means of the screw 32. Since the part 65 is in any case prevented from rotating, a grooved portion 41 on the latter is sufficient and none is needed on the covering sheet.

Since the hotplates are preferably packed in a position offset by 180°, the depression 61 is diametrically opposite the insulating member 55. Of course, it would also be possible to offset the hotplates by a different angle. The depression 61 would then also have to be offset by a different angle relative to the insulating member 55. In any case, the advantage of the covering sheet is that it is easy to produce owing to its not very great deformation, in spite of being sufficiently rigid, and it provides a sealed inner space which gives good insulation. In an embodiment having a central perforation for a central sensor cell, the cover could abut both on the outer border 21 and also on the inner edge surrounding the sensor recess, with a step, to follow the covering sheet. Here, again, hollow screws could be used for securing. In this case, therefore, the pin with the internal thread would, for example, not be located centrally but would be in the region of the outer border.

We claim:

1. Stackable hotplates, each having a hotplate member with a downwardly directed annular border on its outer periphery, the border having a free lower edge, and each comprising:

a covering sheet having an outwardly directed flange and having adjacent to the flange a step directed towards the inside of the hotplate, said flange resting on the free lower edge of the border and said step cooperating with the inner circumference of the border in order to center the covering sheet, the covering sheet having an opening and an upwardly projecting depression, the opening and the depression being radially equally spaced from the center of the covering sheet but angularly displaced from one another; and, an insulating member disposed in the opening and projecting downwardly from the covering sheet, electrical connections for the hotplate member passing through the insulating member, whereby stacking two of said hotplates together, with their covering sheets facing one another, the insulating member of each hotplate fits into the depression of the other hotplate, minimizing the stacked height.

2. An electric hotplate according to claim 1, wherein the depression is sufficiently larger than the insulating member to accommodate a connecting member as well.

3. Stackable electric hotplates according to claim 1, wherein a small segment of the border of each of the hotplates has a recess in the lower edge and the covering sheet of each of the hotplates has a corresponding embossed portion directed towards the hotplate member which engages in the recess, fixing the hotplate member and the covering sheet against relative rotational movement without increasing the stacked height.

4. Stackable electric hotplates according to claim 1, further comprising packing plates, each having cutouts for receiving and centering the hotplates, disposed between facing undersides of the electric hotplates as stacked.

5. Stackable electric hotplates according to claim 4, wherein the cutouts are substantially circular, and have a diameter smaller than the diameter of the borders of the hotplate members, whereby the packing plates will prevent contact between adjacent borders of stacked hotplates.

6. Stackable electric hotplates according to claims 1, 4 or 5, further comprising an intermediate protective film disposed between the facing cooking surfaces of the electric hotplates as stacked.

7. Stackable electric hotplates according to claims 1 or 3, wherein the angular displacement of the opening and the depression in the covering sheet of each of the hotplates is approximately 180°.

8. An electric hotplate, comprising: a hotplate member with a downwardly directed annular border on its outer periphery, the border having a free lower edge;

a mounting bracket for the hotplate, attached to the underside of the hotplate member and anti-rotation fixing means projecting upwardly from the mounting bracket; and, a covering sheet having an outwardly directed flange and having adjacent to the flange a step directed towards the inside of the hotplate, said flange resting on the free lower edge of the border and said step cooperating with the inner circumference of the border in order to center the covering sheet, the covering sheet having at least one sleeve-shaped recess, closed off from inside of the hotplate, receiving said anti-rotation fixing means, and the covering sheet being secured against rotational movement relative to the hotplate member.

9. An electric hotplate according to claim 8, wherein the at least one sleeve-shaped recesss is formed integrally from the covering sheet.

10. An electric hotplate according to claim 8, wherein the covering sheet has at least one opening therein, and further comprising at least one separately formed sleeve-shaped member defining therein the at least one sleeve-shaped recess, the at least one sleeve-shaped member being fixed in the at least one opening.

11. An electric hotplate according to claim 8, further comprising a seal interposed between the covering sheet and border.

12. An electric hotplate according to claim 8, wherein the lower edge of the border has an external border portion running round it and projecting downwardly over the abutment edge for the covering sheet.

13. An electric hotplate according to claim 8, wherein a small segment of the border has a recess in the lower edge and the covering sheet has a corresponding embossed portion directed towards the hotplate member which engages in the recess, fixing the hotplate member and the covering sheet against relative rotational movement.

14. An electric hotplate according to claim 8, wherein the cover sheet and hotplate member define an inner space, and further comprising insulation disposed in the space on the side thereof adjacent the covering sheet.

15. An electric hotplate according to claim 14, wherein the insulation comprises a metal foil.

16. An electric hotplate according to claim 15, wherein the metal foil is clamped between the covering sheet and the border of the hotplate member.

17. An electric hotplate according to claim 8, wherein the cover sheet and hotplate member define an inner space, and further comprising a drying agent disposed in the inner space.

* * * * *